US005974705A

United States Patent [19]

Isley et al.

[11] Patent Number: 5,974,705

[45] **Date of Patent: *Nov. 2, 1999**

[54] SNUBBER FOR EXCAVATOR BUCKET DOOR

[75] Inventors: Reggald Emory Isley; Robert Myles Buchan, both of Grande Prairie; Douglas Calvin Gatter, Tumbler Ridge, all of Canada

[73] Assignee: Risley Enterprises Ltd., Canada

[ * ] Notice: This patent is subject to a terminal disclaimer.

[21] Appl. No.: 08/936,589

[22] Filed: Sep. 24, 1997

Related U.S. Application Data

[63] Continuation of application No. 08/639,219, Apr. 26, 1996, Pat. No. 5,735,067.

[51] Int. Cl.[6] ..... F16F 9/14

[52] U.S. Cl. ..... 37/444; 37/445; 188/307

[58] Field of Search ..... 37/444, 445, 901, 37/903; 188/322.11, 307, 306, 322.2; 414/565, 715, 706, 699

[56] References Cited

U.S. PATENT DOCUMENTS

| | | | |
|---|---|---|---|
| 3,140,080 | 7/1964 | Rumsey | 267/1 |
| 3,402,486 | 9/1968 | Branson | 37/444 |
| 4,006,832 | 2/1977 | Auxen et al. | 37/445 X |
| 4,054,186 | 10/1977 | Banks, Jr. et al. | 188/184 X |
| 4,057,237 | 11/1977 | Nemeth | 188/113 X |
| 4,063,373 | 12/1977 | Greer . | |
| 4,609,081 | 9/1986 | Hungerford | 188/307 |
| 4,723,639 | 2/1988 | Hungerford | 188/307 |
| 4,770,083 | 9/1988 | Johnson | 414/699 X |
| 5,064,033 | 11/1991 | Koike . | |

*Primary Examiner*—Robert E. Pezzuto
*Attorney, Agent, or Firm*—Chernoff, Vilhauer, McClung & Stenzel

[57] ABSTRACT

A Snubber is used to damp the swing of the door on an excavator bucket to prevent the door form being damaged by repeatedly slamming shut. The snubber has housing which mounts to an excavator bucket and a shaft pivotally mounted in the housing and connected to an excavator door. The shaft turns when the excavator door opens. The housing has a cylindrical cavity around the shaft. The cavity is divided into two volumes by a dam and a wiper arm on the shaft. The wiper arm forces hydraulic fluid to flow through an orifice between the volumes as the shaft turns. The wiper arm has end seals which seal against end walls of the cavity. The end seals are forced outwardly by hydraulic pressure when the door is closing. A one-way valve allows hydraulic fluid to bypass the orifice while the door is opening. The snubber requires less maintenance than previous friction snubbers.

16 Claims, 8 Drawing Sheets

SNUBBER FOR EXCAVATOR BUCKET DOOR

CROSS-REFERENCE TO RELATED APPLICATIONS

This application is a continuation of application Ser. No. 08/639,219 filed Apr. 26, 1996 now U.S. Pat. No. 5,735,067, and entitled SNUBBER FOR EXCAVATOR BUCKET DOOR.

FIELD OF THE INVENTION

This invention relates to a snubber for damping the closing of the door on an excavator bucket.

BACKGROUND OF THE INVENTION

Some excavators, for example the model P&H 2800 excavators manufactured by HARSNISCHFEGER CORP. of Milwaukee, Wis., U.S.A. have a bucket mounted at the end of a boom. The bucket has an open front side and a large door on its rear side. The lower edge of the front side has teeth for digging into earth. Excavators of this type are typically very large and are used in open pit mining and the like where vast quantities of earth must be moved. The buckets of such excavators are typically on the order of 3 meters high by 3 meters wide by 3 meters deep and typically have a capacity of 15 to 50 cubic meters of earth.

In a typical mining operation an excavator fills up large dump trucks with coal or ore-containing earth. The trucks haul the earth away for further processing. The excavator operator first scoops up earth with the door on the bucket closed and then moves the boom so that the full bucket is above a truck to be filled, with the door on the rear side of the bucket facing downward. The operator then opens a latch which holds the door shut. The door falls open under its own weight and the weight of the earth in the bucket. The earth in the bucket then falls into the truck. The door closes and latches as the operator moves the bucket into position to scoop up another load of earth.

A problem excavators of this type is that the bucket doors take extreme punishment. The doors slam shut very hard. In some cases the doors slam shut so hard that they bounce open before the latch can engage properly. Over time, even though they are typically fabricated from steel plate which is between 2.5 and 5 centimeters thick and are reinforced by steel ribs, these doors develop cracks. When a door gets too severely cracked it must be taken out of service and repaired.

Most excavators are equipped with a snubber to reduce damage to the door by reducing the impact with which the door closes. Snubbers are subjected to extreme forces. Excavator bucket doors are rapidly forced open by the weight of several tonnes of earth and then swing closed again. The snubbers operate in dirty conditions. In many mine sites excavators operate virtually continuously all day and all night for weeks on end.

One type of snubber, which is described in Australian patent application No. 8780908 uses friction to damp the motion of a bucket door. A typical friction snubber comprises a stack of friction discs. Friction disk type snubbers may be obtained, for example, from ESCO of Portland Oreg., U.S.A. or HARSNISCHFEGER CORP. of Milwaukee, Wis. A first set of the discs is mounted to the excavator bucket. A second set of the discs is interleaved between the discs in the first set. the second set of discs is mounted to a linkage connected to the bucket door. When the door opens or closes the second set of discs turns with respect to the first set of discs. The friction discs are all clamped tightly together with a bolt and a spring washer. Friction between the discs damps the opening and closing of the door.

One problem with friction type snubbers are that the friction discs wear as the door opens and closes. This wear is made worse by dirt and moisture which can get between the disks. To keep friction snubbers working effectively the bolt which holds the friction discs together must be periodically tightened. In many cases, these bolts are not tightened properly or often enough and door damage results. Another problem with friction type snubbers is that they damp opening of the door as well as closing of the door.

A second type of snubber comprises a thick strip of elastomer which is connected to the door by a linkage. When the door closes the elastomer strip stretches. A problem with elastomer strip snubbers is that the elastomer eventually wears out and ceases to damp the closing of the door. The elastomer bands also tend to break frequently when the weather is cold.

SUMMARY OF THE INVENTION

An object of this invention is to provide a hydraulic snubber capable of withstanding the extreme forces generated on the closing of the door on an excavator bucket. A further object of the invention is to provide an excavator bucket having a hydraulically snubbed door. Yet another object of the invention is to provide a snubber for an excavator bucket door which avoids at least some of the disadvantages of the prior art snubbers discussed above. Further and other objects and advantages of the invention will become readily apparent to those skilled in this art from the following detailed description.

This invention provides a hydraulic snubber for an excavator bucket door. The snubber comprises a housing enclosing a cavity, the cavity having end walls and an outer wall; a shaft pivotally mounted to the housing, passing axially through the cavity, and extending through at least one of the end walls; a wiper arm on the shaft in the cavity for rotation with the shaft, the wiper arm having a leading side the wiper arm in slidable and sealing engagement with the end walls and the outer wall; a sealing surface on the shaft; a dam member extending from the outer wall to the shaft sealing surface between the end walls, the dam and the wiper arm dividing the cavity into first and second sealed volumes, with the leading side of the wiper arm in the first sealed volume; a flow restrictor having one end in fluid contact with the first sealed volume and another end in fluid contact with the second sealed volume; a one way valve having an inlet in fluid contact with the second sealed volume and an outlet in fluid contact with the first sealed volume; and a fluid in the first and second sealed volumes. Rotation of the shaft in a first direction increases pressure in the first sealed volume and causes the fluid to flow through the flow restrictor. Rotation of the shaft in a second direction opposite to the first direction increases pressure in the second sealed volume and causes the fluid to flow through the one way valve.

Another aspect of the invention provides a snubber for damping the closing of a door on an excavator bucket. The snubber comprises a housing mountable to an excavator bucket, the housing defining a cavity having opposed first and second end walls and an outer wall, a stationery dam member within the cavity, the dam member extending between the end walls; a pivotally movable wiper arm in the cavity, the wiper arm having a leading face, the wiper arm and the dam member dividing the cavity into sealed first and second volumes with the leading side of the wiper arm in the first volume; sealing means on the wiper arm, the sealing means sealing between the wiper arm and the first and second end walls and between the wiper arm and the outer wall; a shaft extending from the housing, the shaft coupled to the wiper arm so that rotation of the shaft causes pivotal motion of the wiper arm; a flow restrictor having one end in fluid contact with the first volume and another end in fluid contact with the second volume; a one way valve having an inlet in fluid contact with the second volume and an outlet in fluid contact with the first volume; and a fluid in the first and second sealed volumes. The sealing means between the wiper arm and the first end wall comprises a first sealing member; biasing means for biasing the first sealing member against the first end wall; and, a fluid passage extending between the leading side of the wiper arm and a chamber between the sealing member and the wiper arm. Rotation of the shaft in a first direction increases pressure in the first sealed volume and causes the fluid to flow through the flow restrictor. Rotation of the shaft in a second direction opposite to the first direction increases pressure in the second sealed volume and causes the fluid to flow through the one way valve.

Preferably the shaft extends through the wiper arm and the wiper arm is slidably mounted to the shaft. Preferably the sealing means between the wiper arm and the second end wall comprises a second sealing member biased against the second end wall and the wiper arm has at least one fluid passage extending between its leading face and a sealed chamber between the second sealing member and the wiper arm. Most preferably the shaft is fixed longitudinally with respect to one of the end walls and the shaft is free to slide at least slightly longitudinally in respect of another one of the end walls.

Preferably the bias means comprises a resilient ring which seals the sealed chamber and biases a respective one of the sealing members against a respective one of the end walls.

Another aspect of the invention provides a bucket assembly for an excavator. The bucket assembly comprises: a U-shaped frame having front and rear openings; a door pivotally mounted to the frame, the door having a closed position wherein the rear opening is blocked and an open position wherein the rear opening is substantially unobstructed; a latch operatively associated with the door and the frame for maintaining the door in the closed position; and a snubber connected between the frame and the door. The snubber comprises a housing enclosing a cylindrical cavity, the cavity having generally planar first and second end walls and an outer wall; a shaft pivotally mounted in the housing, passing axially through the cavity, and extending through the first end wall; a wiper arm mounted on the shaft in the cavity for rotation with the shaft, the wiper arm in slidable and sealing engagement with the end walls and the outer wall; a dam member in the cavity extending from the outer wall to a sealing surface on the shaft between the first and second end walls, the dam member and the wiper arm dividing the cavity into first and second sealed volumes; an orifice having one side in fluid communication with the first sealed volume and a second side in fluid communication with the second sealed volume; and a one-way valve having one side in fluid communication with the first sealed volume and a second side in fluid communication with the second sealed volume, the one-way valve open when a fluid pressure in the second volume is greater than a fluid pressure in the first volume. The shaft turns the wiper arm toward the first volume while the door is closing and the shaft turns the wiper arm toward the second volume while the door is opening.

Yet another aspect of the invention provides a bucket assembly for an excavator. The bucket assembly comprises a U-shaped frame having front and rear openings; a door pivotally mounted to the frame, the door having a closed position wherein the rear opening is blocked and an open position wherein the rear opening is substantially unobstructed; a latch operatively associated with the door and the frame for maintaining the door in the closed position; and a snubber connected between the frame and the door. The snubber comprises: a housing enclosing a cylindrical cavity, the cavity having generally planar first and second end walls and an outer wall; a stationery dam member within the cavity, the dam member extending between the end walls; a pivotally movable wiper arm in the cavity, the wiper arm having a leading face, the wiper arm and the dam member dividing the cavity into sealed first and second volumes with the leading side of the wiper arm in the first volume; sealing means on the wiper arm, the sealing means sealing between the wiper arm and the first and second end walls and between the wiper arm and the outer wall; a shaft extending from the housing, the shaft coupled to the wiper arm so that rotation of the shaft causes pivotal motion of the wiper arm; a flow restrictor having one end in fluid contact with the first volume and another end in fluid contact with the second volume; a one way valve having an inlet in fluid contact with the second volume and an outlet in fluid contact with the first volume the one-way valve open when a fluid pressure in the second volume is greater than a fluid pressure in the first volume; and a fluid in the first and second volumes. The sealing means between the wiper arm and the first end wall comprises: a first sealing member; biasing means for biasing the first sealing member against the first end wall; and, a fluid passage extending between the leading side of the wiper arm and a chamber between the sealing member and the wiper arm. The shaft is connected to the door and moves the wiper arm toward the first volume while the door is closing. The shaft moves the wiper arm toward the second volume while the door is opening.

BRIEF DESCRIPTION OF THE DRAWINGS

In drawings which illustrate specific embodiments of the invention, but which should not be construed so as to narrow the scope of the invention.

DETAILED DESCRIPTION OF PREFERRED EMBODIMENTS OF THE INVENTION

Figure 1:
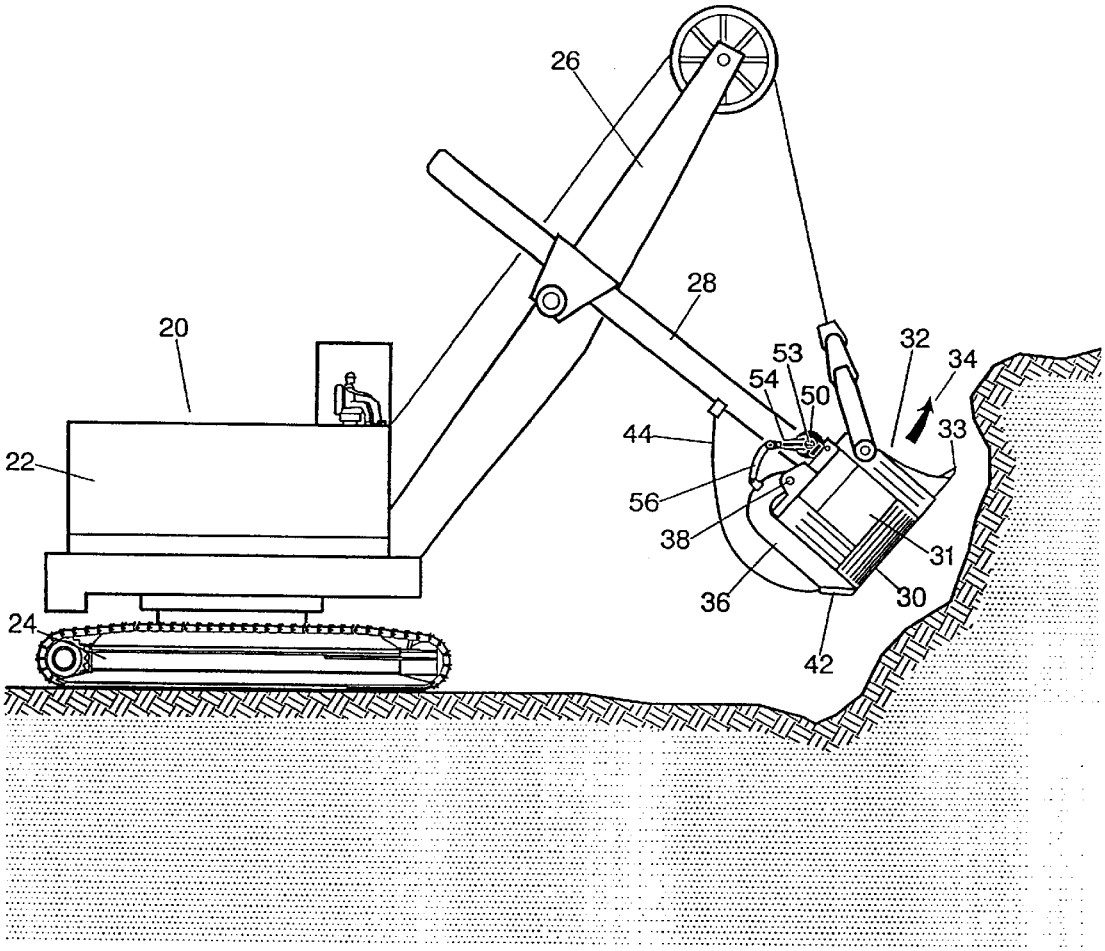
FIG. 1 is an elevational view of a prior art excavator having a bucket with a door and a friction type snubber.

As shown in FIG. 1, an excavator 20 has a superstructure 22 mounted to an undercarriage 24. A boom 26 is mounted to the superstructure and a stick 28 is mounted to the boom. A bucket 30 is mounted at the end of stick 28. Bucket 30 has a rectangular central portion 31 with an open leading edge 32. Teeth 33 are usually mounted along the lower portions of edge 32. The operator of excavator 20 can scoop earth into bucket 30 by moving stick 28 in the direction of arrow 34 so that edge 32 cuts into the earth.

The trailing side of bucket 30 is closed by a door 36 which is pivotally mounted to central portion 31 with pins 38. Door 36 is held shut by a latch 42. The operator can open door 36 by operating a winch (not shown) to pull cable 44. The end of cable 44 is connected to a release on latch 42.

When door 36 is open, the swinging motion of door 36 about pivot pin 38 is damped by snubber 50 which is rigidly fixed to central portion 31 of bucket 30. Snubber 50 comprises a stack of friction plates. One set of the friction plates is rigidly mounted to central portion 31. A second set of the friction plates, which is interleaved with the first set of friction plates, is mounted to a shaft 53. A lever arm 54 is also rigidly mounted to shaft 53. Pivotal motion of lever arm 54 about the axis of shaft 53 causes the second set of friction plates to turn relative to the first set of friction plates. The friction plates are clamped tightly together so that lever arm 54 cannot move unless a force is applied to arm 54 in such a manner that a torque sufficient to overcome the frictional force between the friction discs is applied to shaft 53. Lever arm 54 is linked to door 36 by a link 56. Snubber 50 resists pivotal motion of door 36 in either direction about pivot pin 38.

Figure 2:
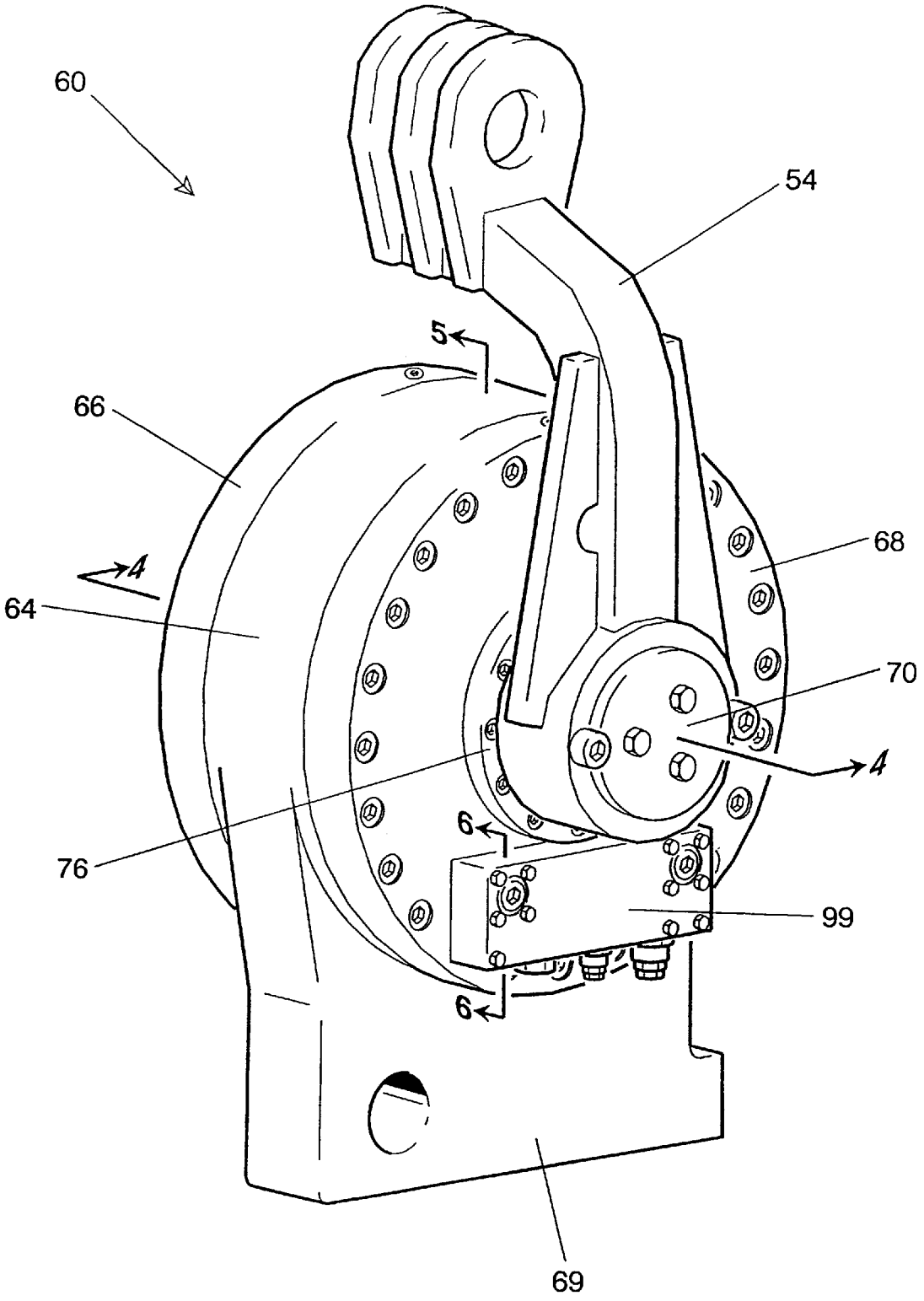
FIG. 2 is a perspective view of a snubber according to the invention.
Figure 3:
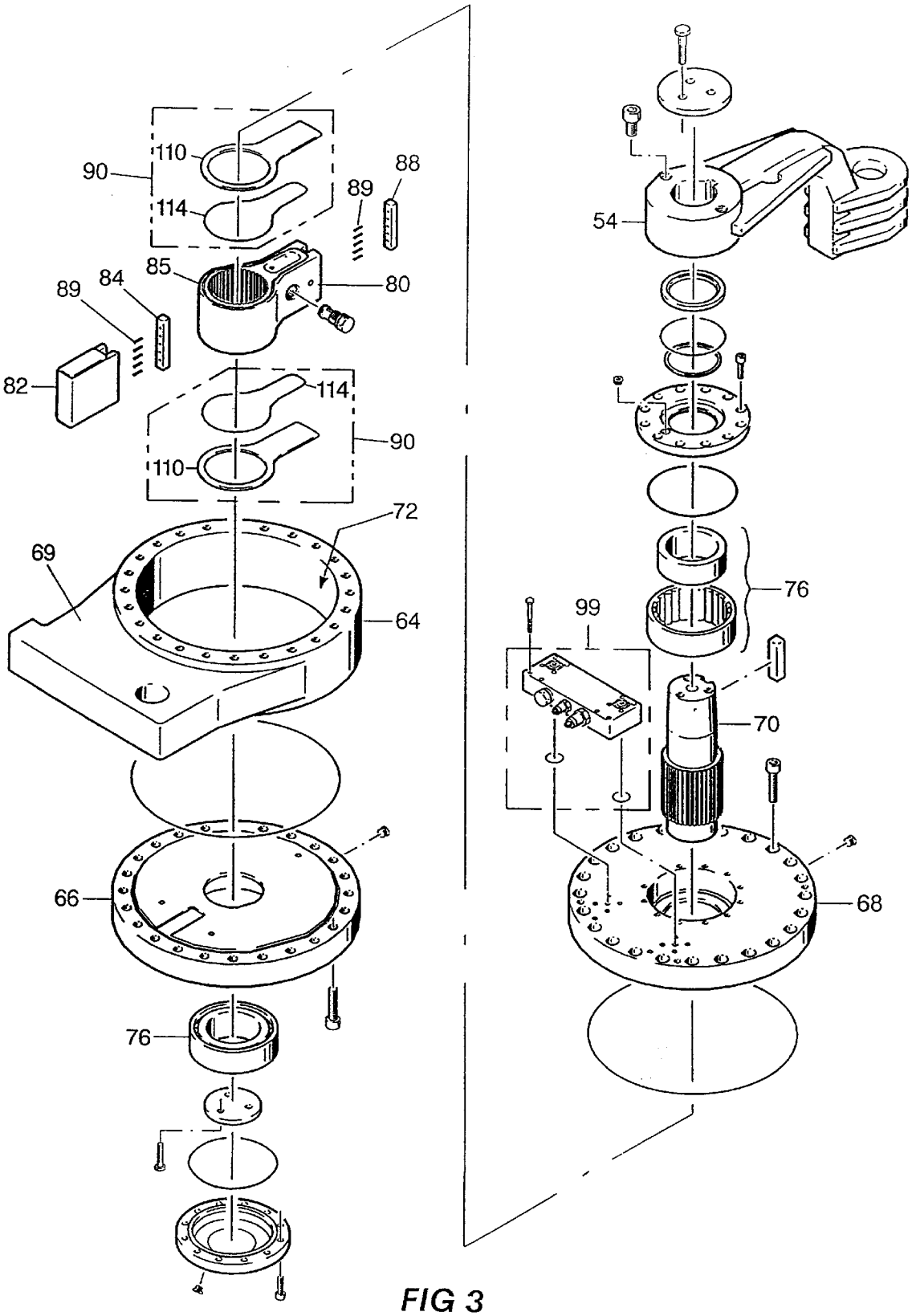
FIG. 3 is an exploded view of the snubber of FIG. 2.
Figure 4:
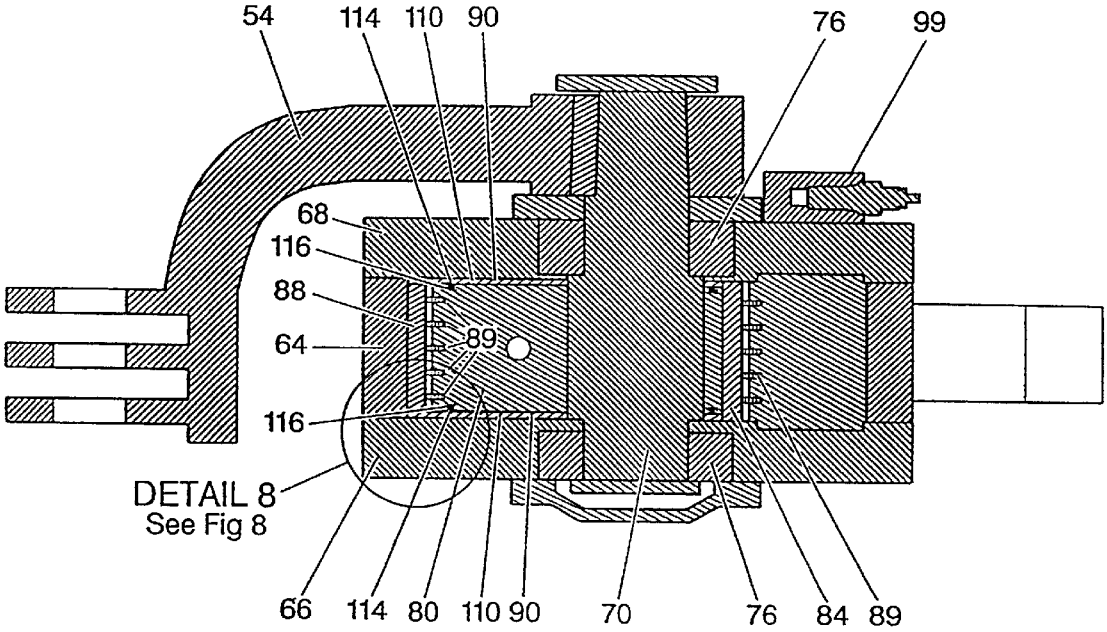
FIG. 4 is a longitudinal elevational section thereof along the line 4—4 of FIG. 2.

FIG. 2 shows a hydraulic snubber 60 according to the invention. Snubber 60 attaches to an excavator bucket in essentially the same manner as the snubber 50 shown in FIG. 1. Snubber 60 has a housing 61 which can be attached to an excavator bucket and an arm 54 which may be connected to a bucket door 36 by a linkage as shown in FIG. 1. A hydraulic mechanism inside housing 61 resists movement of arm 54 in a direction corresponding to the closing of bucket door 36. Housing 61 comprises a cylindrical casing 64 The ends of casing 64 are closed by end plates 66, 68. A bracket 69 is provided for attaching snubber 60 to an excavator bucket.

Arm 54 is attached to a shaft 70 which extends through a cavity 72 inside housing 61. Shaft 70 is pivotally mounted in end plates 66, 68 by bearings 76. The central portion of shaft 70 which passes through cavity 72 is splined. A wiper arm 80 is mounted to shaft 70 inside cavity 72. The splines prevent wiper arm 80 from turning with respect to shaft 70.

Wiper arm 80 and a dam 82 divide chamber 72 into two volumes, 72A and 72B. Volumes 72A and 72B are sealed from each other by: a seal 84 between dam 82 and a cylindrical sealing surface 85 on wiper arm 80; an edge seal 88 on wiper arm 80; and, end seals 90 on wiper arm 80. Seal 84 and edge seal 88 are preferably brass vanes. Volumes 72A and 72B contain a fluid 94 which is preferably a hydraulic fluid such as SHELL™ MG150 available from Shell Canada Products Ltd. at locations throughout Canada.

Volumes 72A and 72B are in fluid communication with each other through a valve block 99. When shaft 70 turns then the volumes of volumes 72A and 72B change and fluid 94 is exchanged between volumes 72A and 72B through valve block 99. Valve block 99 contains an orifice (or "flow control valve") 101 connected in parallel with a one-way valve (or "check valve") 102. One or more additional one way valves (not shown) are preferably mounted in wiper arm 80.

Snubber 60 is linked to door 36 so that wiper arm 80 moves in the direction of arrow 96 (FIG. 5) when door 36 is opening. When shaft 70 turns wiper arm 80 in the direction of arrow 96 then fluid 94 can flow freely from volume 72B to volume 72A through one-way valve 102. The additional one-way valves (not shown) which are preferably mounted in wiper arm 80 increase the rate at which fluid 94 can flow from volume 72B to volume 72A. Thus, snubber 60 offers little resistance to the opening of door 36. It is convenient to make orifice 101, one-way valve 102 and pressure relief valve 103 field replaceable. For example, orifice 101, may be a SUN™ model FDEA-LAN flow control valve cartridge, one-way valve 102 may be a SUN™ model CXGB-XCN check valve cartridge and pressure relief valve 103 may be a SUN™ model RPGC-LAN cartridge, made by SUN HYDRAULICS CORP., all of which are available from TERIS HYDRAULICS LTD. of Edmonton, Alberta, Canada. In the alternative, these components may be custom fabricated. One-way valve 102 may comprise, for example, a ball bearing biased against a valve seat by a weak spring.

When shaft 70 turns wiper arm 80 in the direction of arrow 98 (i.e when door 36 is closing) then one-way valve 102 closes. When one way valve 102 has closed the only way for fluid to flow from volume 72A to volume 72B is through orifice 101. Orifice 101 restricts the flow of fluid 94 through valve block 99. Therefore, when door 36 is closing, the pressure of fluid 94 inside volume 72A rises and the pressure of fluid 94 in volume 72B is reduced. The pressure differential between the two sides of wiper arm 80 causes a torque on shaft 70 which resists the closing of door 36.

The operating characteristics of snubber 60 may be adjusted by changing the size of orifice 101. Making orifice 101 smaller increases the torque with which snubber 60 resists the closure of door 36. Preferably orifice 101 is an adjustable flow control valve with a nominal rating of 0.2 to 25 gallons per minute. Of course the preferred size of orifice 101 will vary depending upon the size of the load experienced by snubber 60.

A pressure relief valve 108 is preferably provided. Pressure relief valve 108 opens if the pressure differential between volumes 72A and 72B exceeds a set level. This prevents damage to snubber 60 that could occur if, for example, orifice 101 became plugged.

It is important to the operation of snubber 60 that seals 84, 88 and 90 are reasonably good. Seals 84 and 88 may comprise, for example, sections of brass vane having sealing surfaces curved to match the curvatures of sealing surface 85 and the inner surface of casing 64 respectively. Springs 89 maintain the brass vanes in forceful contact with the surfaces against which they seal.

End seals 90 should be capable of adapting to movements of end plates 66 and 68. End plates 66 and 68 tend to bulge outwardly when pressure is developed inside chamber 72. In a prototype snubber having an internal diameter of 45 cm. and having end plates made of 7.5 cm thick steel it was found that the end plates were typically forced outwardly by approximately 0.045 inches during the closure of the door on an excavator bucket. This distortion of the end plates permitted enough fluid 94 to flow around the ends of wiper arm 80 to reduce the effectiveness of snubber 60.

To accommodate motion of end plates 66 and 68, each of end seals 90 preferably comprises a deformable plate 110 seated in a recess 112 at one end of wiper arm 80. Plate 110 is supported slightly away from the end surface of wiper arm 80 by a resilient seal, such as an o-ring 114. O-ring 114 sits in a groove 116 within recess 112. One or more apertures 118 extend from the leading surface 120 of wiper arm 80 (i.e. the surface of wiper arm 80 which is moving into fluid 94 when door 36 is closing) to a chamber 122 between the end surface of wiper arm 80 and plate 110. The peripheral edges of chamber 122 are sealed by o-ring 114. Preferably shaft 70 passes through an aperture 111 in plate 110.

Figure 7:
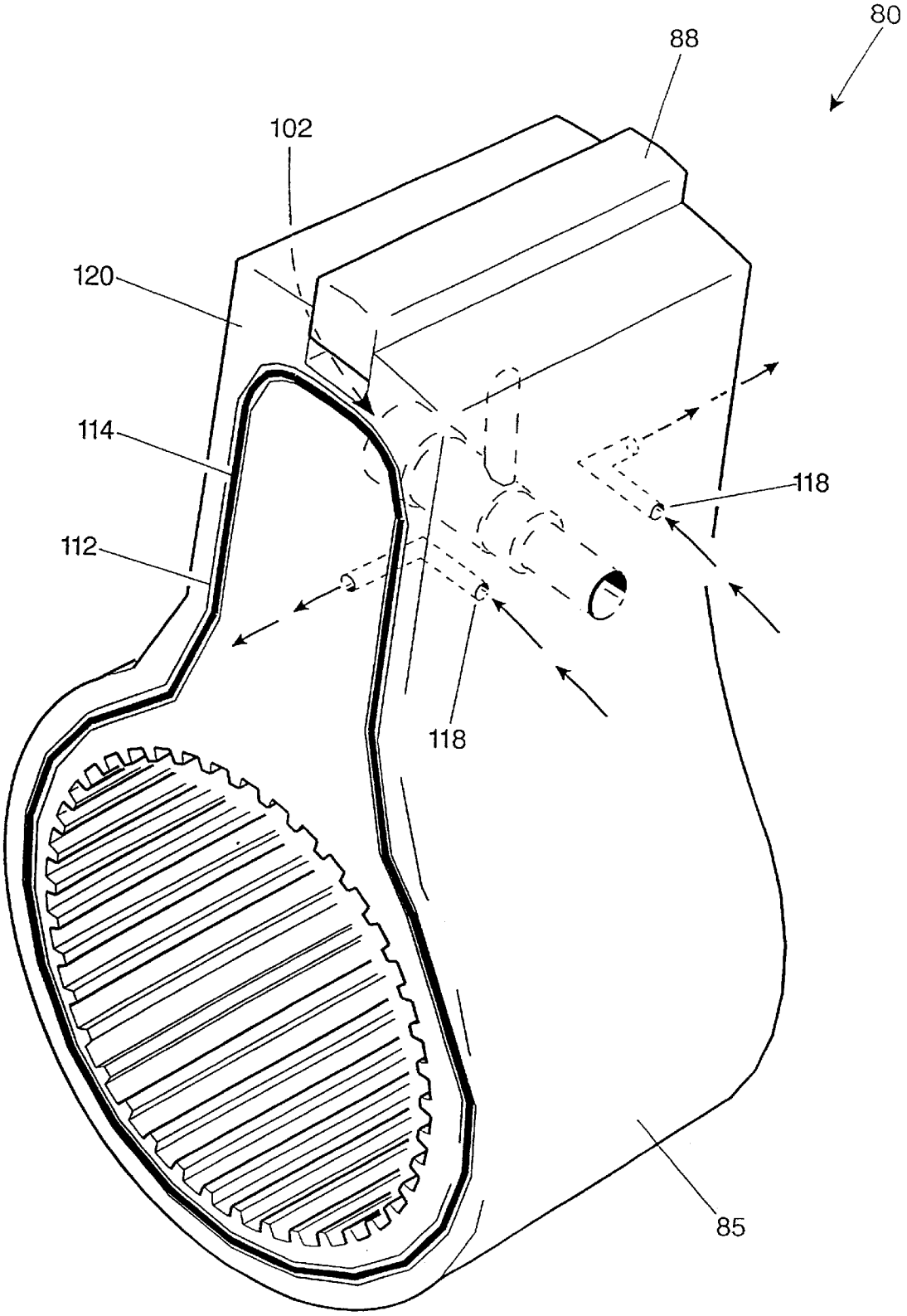
FIG. 7 is a perspective view of a wiper arm from a snubber according to the invention.
Figure 8:
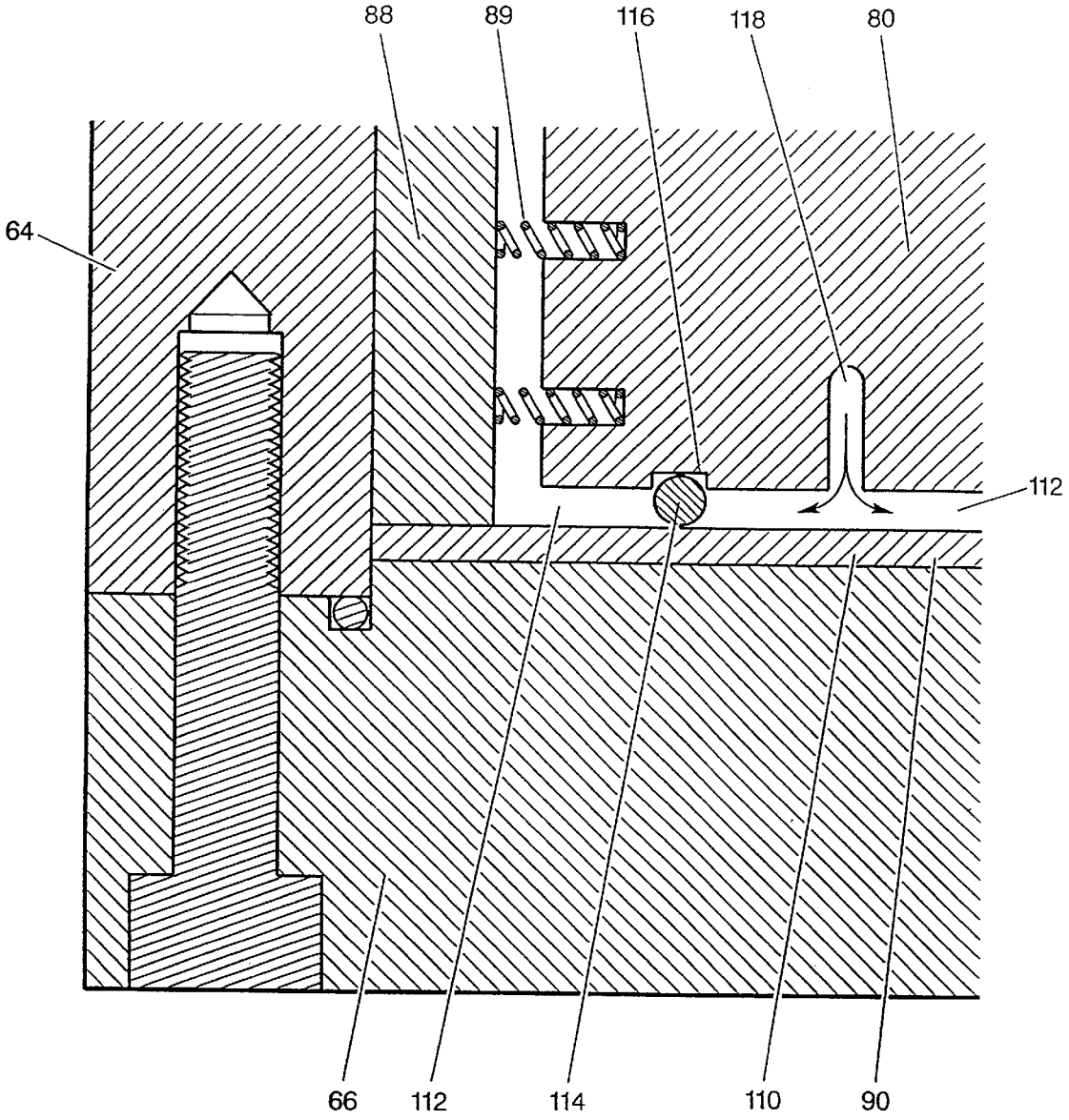
FIG. 8 is a detailed longitudinal section along the line 8—8 of FIG. 4; and, FIG. 9 is a schematic view of the components shown in FIG. 6.

As shown in FIGS. 7 and 8, when door 36 is closing fluid 94 is compressed in front of leading surface 120 of wiper arm 80. Apertures 118 allow fluid 94 to flow into chamber 122 until the pressure in chamber 122 is equalized with the pressure in cavity 72A. The pressure inside chamber 122 forces plate 110 against the inner surface of end plate 66 (or 68). Preferably plate 110 is fabricated from a material which is flexible enough to conform to any changes in the profile of end plate 66. For example, plate 110 may be made of nylon or nylon backed by a sheet of brass. A preferred material for plate 110 is the NYLOTRON™ material available from Nylatech Inc. of Everson Wash., U.S.A. The greater the pressure in cavity 72A the greater the pressure in chamber 122 and the more tightly sealing plates 110 are forced against the end walls of chamber 72.

Preferably wiper arm 80 is splined to shaft 70 so that it can slide longitudinally along shaft 70 but cannot turn with respect to shaft 70. This permits the outward pressure of end seals 90 to keep wiper arm 80 centered from end to end in cavity 72 as end plates 66 and 68 move. This self-centering action of wiper arm 80 helps to keep the clearances between the ends of wiper arm 80 and end plates 66 and 68 approximately equal so that neither one of end-seals 90 is forced to accommodate all of the changes in clearance that result if end plates 66 and 68 are deformed by the pressures developed within snubber 60. It is also preferable to mount shaft 70 so that it is fixed longitudinally with respect to end plate 66 but is free to slide slightly in and out in end plate 68. This prevents end plates 66 and 68 from applying large side loads to bearings 76 as end plates 66 and 68 flex.

Snubber 60 may be mounted to an excavator bucket in many ways. Preferably snubber 60 should be mounted so that any gas which may be accidentally introduced into chamber 72 stays at the top of chamber 72 and does not enter valve block 99 anywhere in the normal range of motion of the bucket 30. It is generally preferable to mount housing 61 to bucket 30 and to turn shaft 70 by means of a linkage attached to door 36.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

We claim:

1. A snubber for damping the closing of a door on an excavator bucket, the snubber comprising:

(a) a housing mountable to an excavator bucket, the housing defining a cavity having opposed first and second end walls and an outer wall;

(b) a stationery dam member within the cavity, the dam member extending between the end walls;

(c) a pivotally movable wiper arm in the cavity, the wiper arm having a leading face, the wiper arm and the dam member dividing the cavity into sealed first and second volumes with the leading side of the wiper arm in the first volume;

(d) sealing means on the wiper arm, the sealing means sealing between the wiper arm and the first and second end walls and between the wiper arm and the outer wall, the sealing means between the wiper arm and the first end wall comprising:

(i) a first sealing member;

(ii) biasing means for biasing the first sealing member against the first end wall; and, (iii) a fluid passage extending between the leading side of the wiper arm and a chamber between the sealing member and the wiper arm;

(e) a shaft extending from the housing, the shaft coupled to the wiper arm so that rotation of the shaft causes pivotal motion of the wiper arm;

(f) a flow restrictor having one end in fluid contact with the first volume and another end in fluid contact with the second volume; and, (g) a fluid in the first and second sealed volumes;

wherein rotation of the shaft in a first direction increases pressure in the first sealed volume and causes the fluid to flow through the flow restrictor and rotation of the shaft in a second direction opposite to the first direction increases pressure in the second sealed volume and causes the fluid to flow through the one way valve.

2. The snubber of claim 1 comprising a one way valve having an inlet in fluid contact with the second volume and an outlet in fluid contact with the first volume.

3. The snubber of claim 2 wherein the shaft extends through the wiper arm and the wiper arm is slidably mounted to the shaft.

4. The snubber of claim 3 wherein the sealing means between the wiper arm and the second end wall comprises a second sealing member biased against the second end wall and the wiper arm has at least one fluid passage extending between its leading face and a sealed chamber between the second sealing member and the wiper arm.

5. The snubber of claim 4 wherein a plurality of fluid passages extend in the wiper arm between the leading face of the wiper arm and each of the sealed chambers between the first and second sealing members and the wiper arm.

6. The snubber of claim 2 wherein the sealing means between the wiper arm and the second end wall comprises a second sealing member biased against the second end wall and the wiper arm has at least one fluid passage extending between its leading face and a sealed chamber between the second sealing member and the wiper arm.

7. The snubber of claim 6 wherein a plurality of fluid passages extend in the wiper arm between the leading face of the wiper arm and each of the sealed chambers between the first and second sealing members and the wiper arm.

8. The snubber of claim 7 wherein each of the sealed chambers is sealed by a resilient ring and the resilient ring biases a respective one of the sealing members against a respective one of the end walls.

9. The snubber of claim 2 wherein the flow restrictor is a variable flow restrictor.

10. The snubber of claim 2 comprising a usually closed pressure relief valve in a fluid passage extending between the first and second volumes, the pressure relief valve opening whenever a pressure differential across the pressure relief valve exceeds a preset value.

11. The snubber of claim 1 comprising a usually closed pressure relief valve in a fluid passage extending between the first and second volumes, the pressure relief valve opening whenever a pressure differential across the pressure relief valve exceeds a preset value.

12. The snubber of claim 3 wherein the shaft is fixed longitudinally with respect to one of the end walls and the shaft is free to slide at least slightly longitudinally in respect of another one of the end walls.

13. The snubber of claim 2 comprising two one way valves each having an inlet in fluid contact with the second volume and an outlet in fluid contact with the first volume, one of the one way valves mounted in an aperture in the wiper arm and a second one of the one-way valves mounted in the housing.

14. A bucket assembly for an excavator, the bucket assembly comprising:

(a) a U-shaped frame having front and rear openings;

(b) a door pivotally mounted to the frame, the door having a closed position wherein the rear opening is blocked and an open position wherein the rear opening is substantially unobstructed;

(c) a latch operatively associated with the door and the frame for maintaining the door in the closed position;

(d) a snubber connected between the frame and the door, the snubber comprising:

i) a housing enclosing a cylindrical cavity, the cavity having generally planar first and second end walls and an outer wall;

ii) a stationery dam member within the cavity, the dam member extending between the end walls;

iii) a pivotally movable wiper arm in the cavity, the wiper arm having a leading face, the wiper arm and the dam member dividing the cavity into sealed first and second volumes with the leading side of the wiper arm in the first volume;

iv) sealing means on the wiper arm, the sealing means sealing between the wiper arm and the first and second end walls and between the wiper arm and the outer wall, the sealing means between the wiper arm and the first end wall comprising:

1) a first sealing member;

2) biasing means for biasing the first sealing member against the first end wall; and, 3) a fluid passage extending between the leading side of the wiper arm and a chamber between the sealing member and the wiper arm;

v) a shaft extending from the housing, the shaft coupled to the wiper arm so that rotation of the shaft causes pivotal motion of the wiper arm;

vi) a flow restrictor having one end in fluid contact with the first volume and another end in fluid contact with the second volume; and, vii) a fluid in the first and second volumes;

wherein the shaft moves the wiper arm toward the first volume while the door is closing and the shaft moves the wiper arm toward the second volume while the door is opening.

15. The bucket assembly of claim 14 wherein the snubber comprises a one way valve having an inlet in fluid contact with the second volume and an outlet in fluid contact with the first volume the one-way valve open when a fluid pressure in the second volume is greater than a fluid pressure in the first volume.

16. The bucket assembly of claim 15 wherein the flow restrictor is a variable flow restrictor.

* * * * *

UNITED STATES PATENT AND TRADEMARK OFFICE

CERTIFICATE OF CORRECTION

Figure 5:
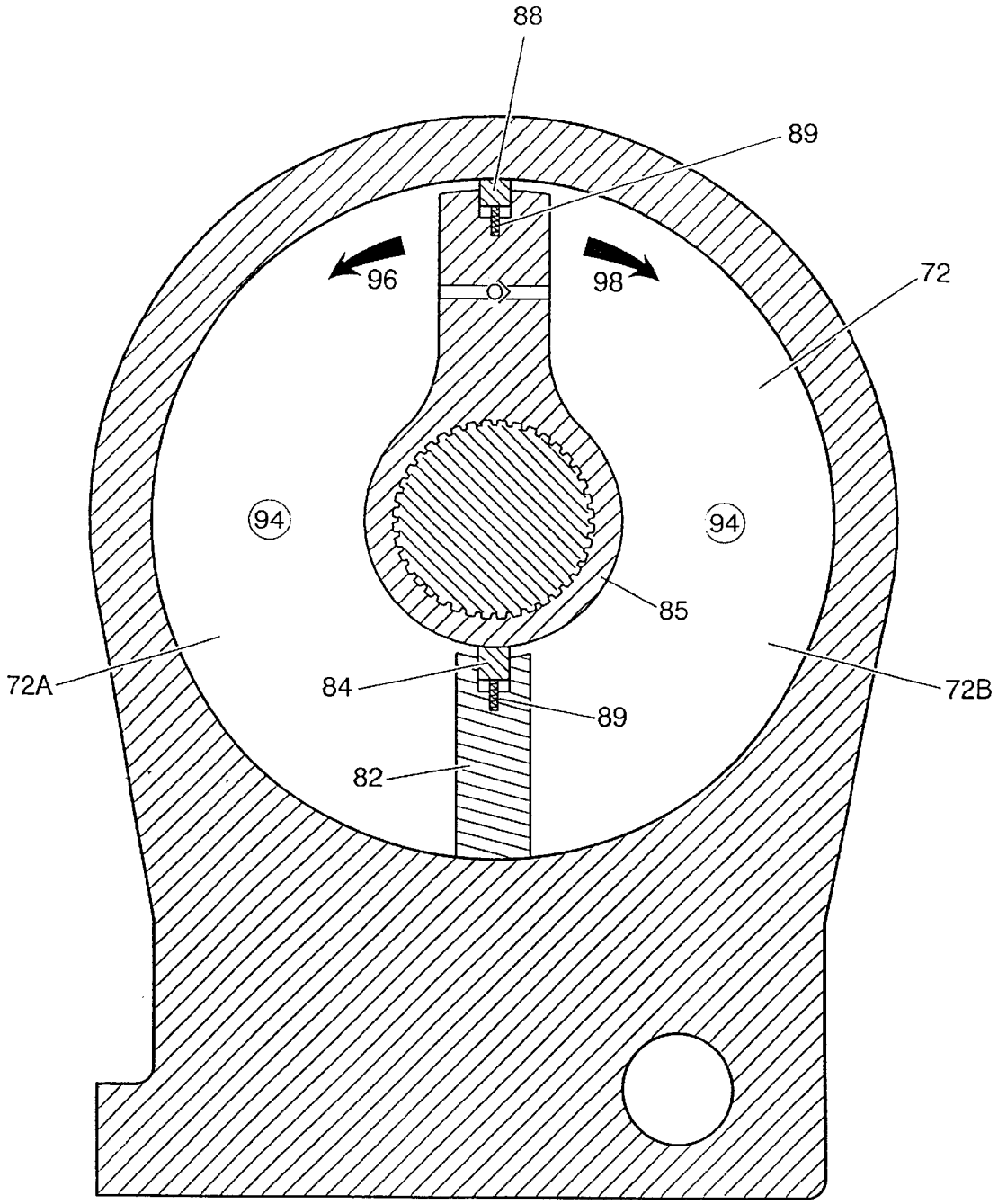
FIG. 5 is a transverse section thereof along the line 5—5 of FIG. 2.
Figure 6:
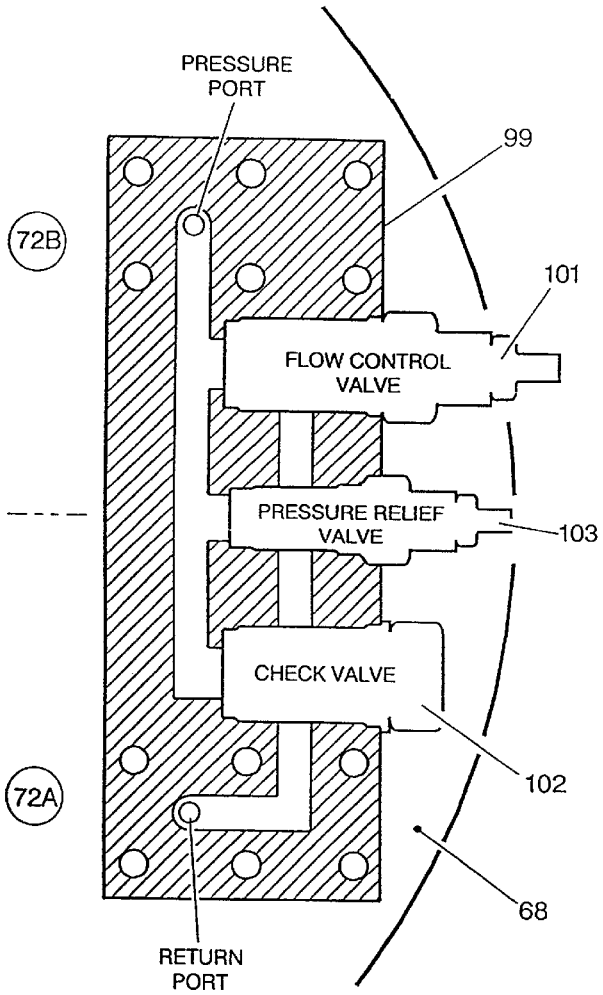
FIG. 6 is a partially schematic longitudinal plan section thereof along the line 6—6 of FIG. 2.
Figure 9:
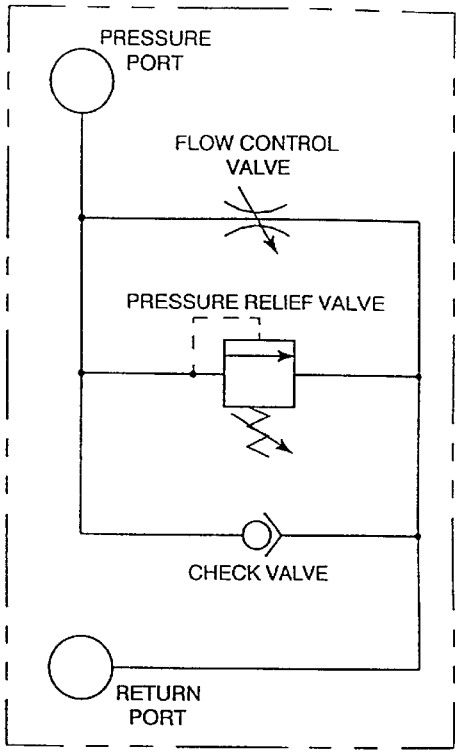

PATENT NO. : 5,974,705 
DATED : November 2, 1999
INVENTOR(S) : Reggald Emory Isley, Robert Myles Buchan and Douglas Calvin Gatter It is certified that error appears in the above-identified patent and that said Letters Patent is hereby corrected as shown below:

Drawings,
Figure 5, change reference numeral "72A" to -- 72B --;
Figure 5, change reference numeral "72B" to -- 72A --; and
Figure 7, move the lead line for reference numeral 120 so that reference numeral 120 identifies the surface which is penetrated by apertures 118.

Signed and Sealed this

Twenty-first Day of June, 2005

JON W. DUDAS
*Director of the United States Patent and Trademark Office*